United States Patent [19]

Colom et al.

[11] Patent Number: 4,960,429

[45] Date of Patent: Oct. 2, 1990

[54] CHROMIUM FREE PROCESS FOR THE TANNING OF HIDES

[75] Inventors: Roberto C. Colom; Jordi J. Duque Ros; Juan J. P. Herrerq, all of Barcelona, Spain

[73] Assignee: Hispano Quimica, S.A., Barcelona, Spain

[21] Appl. No.: 321,006

[22] Filed: Mar. 9, 1989

[30] Foreign Application Priority Data

Nov. 17, 1988 [ES] Spain ..... 8803504

[51] Int. Cl.[5] ..... C14C 3/02; C14C 3/04

[52] U.S. Cl. ..... 8/94.26; 8/94.1 R

[58] Field of Search ..... 252/94.1 R, 94.26

[56] References Cited

U.S. PATENT DOCUMENTS 3,934,975 1/1976 Kelly et al. ..... 8/94.24

4,731,089 3/1988 Covington ..... 8/94.27

*Primary Examiner*—Paul Lieberman

*Assistant Examiner*—John F. McNally

*Attorney, Agent, or Firm*—Birch, Stewart, Kolasch & Birch

[57] ABSTRACT

A process for the tanning of skins applicable to lamb, goat, calf hides, or skins from other origins. The process is based in the previous modification of the collagen of the skin by covalent reaction with polyfunctional polymers with a high quantity of hydroxylic groups. The modification treatment may be carried out after bated skin or pickled skin has been previously depickled. After binding of the polymer, the reactivity of the skin substrate is modified whereby it will show a higher affinity for titanium salts, for example ammonium titanyl double sulphate, titanyl sulphate or any other soluble titanium compound.

7 Claims, No Drawings

CHROMIUM FREE PROCESS FOR THE TANNING OF HIDES

DESCRIPTION

The present invention relates a process for tanning hides and animal skins avoiding completely the use of chromium compounds for strategical and ecological reasons.

Within the eventual metals to be used, titanium is the most appropriate as it is the element number 9 for its abundance on earth and well distributed worldwide. Besides, titanium in form of titanium dioxide, as it is found in process residues, is completely stable and accepted as being non-toxic and non-contaminating.

In the same way, the polymers which will be used according to the present invention do not present any ecological hazards, as they are derived from natural products which are accepted as being non-toxic and non-contaminating.

The rest of the products to be used as auxiliary or complementary products have been selected with the aim of making the overall process as ecological as possible.

The present invention discloses a process for the tanning of any type of skins which is based on a covalent reaction of collagen which modifies the affinity of the substrate skin to the metallic salts, specially titanium soluble salts.

The use of titanium salts is already known in this field. Specially the ammonium titanyl double sulphate salt which is directly applied to the hide without previous reactive modifications.

The following Patent specifications will be considered as a matter of reference. Spanish Patent No. 490.773 filed on Apr. 22nd, 1980 with priority of USSR Patent Nos. 2.831.651 and 2.831.652 filed on Nov. 11th, 1979. The equivalent British Patent No. 2.062.596A filed on May 12th, 1980 and U.S. Pat. No. 3,938,951 filed on Mar. 20th, 1973.

In these references, the use of phthalic anhydride is mentioned as a tanning activator, although this compound cannot undergo a covalent reaction with the hide given the fact that the shrinkage temperature is not increased. Other Patents, as for example, European Patent No. 0128702 with priority of Italian Patent No. 2155083 of 10-06-83 and filing number 84303637.7 mentions the use of titanium masking agents like citric and other organic acids as explained also by M. P. Swany of the Central Leather Research Institute, Madras, in 1983.

The use of natural and synthetic tannins is also commonly cited, but these have the drawback of producing a strong yellow color with titanium salts, specially when phenolic hydroxyls are present.

The present invention comprises a tanning process which obtains tanned hides with irreversible binding of the metallic salt as shown by the fact that the shrinkage temperature reaches above 95° C. after washing and neutralization, the tanned hides obtain a good aspect and feel, and all mechanical operations common in tanning processes can be readily carried out. The process comprises the use of any titanium soluble salt, preferably ammonium titanyl double sulphate, without the need of using masking agents, such as citric acid or other organic acids. With the purpose of making tannages with titanium salts in the conditions that have been described, a preliminary modification will be carried out in the collagen of the skin utilizing a polyfunctional polymer of the hydroxylated aldehydic type, constituted by the following compounds:

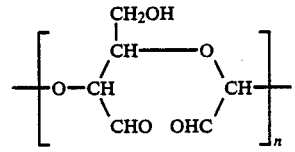

A

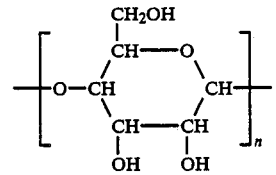

B

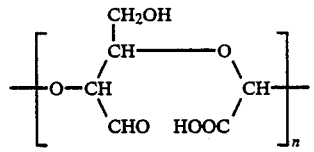

C

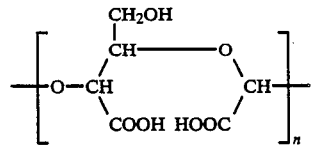

D

The proportions are such that compounds A and B predominate over compounds C and D, with fraction D the minor part.

Fraction A shows the highest affinity towards the collagen. It is a semiacetal of glyoxal and erithrose, and behaves like other glyoxals in this respect.

Fraction B shows the highest affinity towards the titanium besides having the group —$CH_2OH$ as in A, has geminal alcohols.

The polymer compound contains compounds A and B in a ratio between 20:80 and 90:10, preferably 50:50.

Fractions A and D combine with the aminic groups of the collagen, producing a first crosslinkage (first stage with final temperature between 70° C. and 85° C.) leaving the hydroxilic groups free which are able to coordinate with the titanium salts, binding them irreversibly (second stage with final temperature above 95° C.).

At the same time, the excessive hydrophily which might remain in the hide if it is only treated with such polymer will disappear. Due to its high molecular weight and its poor solubility, it is a practically non-toxic product, and it does not present any ecological hazard.

The reaction of hydroxilated polymers with titanium salts is evidenced by its binding with different substrates which have been in contact with soluble titanium salts, specially ammonium titanyl double sulphate. Table 1 shows the results of the experimentation carried out on this subject.

TABLE I

| | ABSORPTION | | BINDING |
|---|---|---|---|
| | pH: 0,7 | pH: 2,5 | pH: 2,5 |
| PICKLED SKIN: collagenic protein | 22% | 90% | 90% |
| WOOL: Collagen without hydroxi-protein, with | 7% | 72% | 16% |

TABLE I-continued

| | ABSORPTION | | BINDING |
|---|---|---|---|
| | pH: 0,7 | pH: 2,5 | pH: 2,5 |
| bisulphide bonds (without OH groups) | | | |
| COTTON: Polysacarides (OH groups) | 8% | 77% | 45% |
| NYLON: polyamide (peptidic groups) | 8% | 72% | 12% |
| ACRILOIC FABRIC: Polyacrilonitrile (CN groups) | 16% | 75% | 30% |
| NYLON/POLYURETHANE | 8% | 73% | 7% |
| COTTON/POLYESTER (30/70) | 11% | 74% | 14% |

The affinity of hydroxylated polymers for titanium is also evidenced by the fact that after preparing starch films, if they are covered with a titanyl sulphate solution, the binding of the titanium to such film will take place to the extent of 15% to 20%. The most surprising fact is that after treating these films with boiling water, the film which has not been in contact with the titanium solution dissolves completely, while the treated film resists the test.

The use of polysaccharide polymers with aldehydic groups has been described in detail in previous publications. However, in spite of all tests carried out, the majority of them within the period 1957–1962, and in spite of various Patents concerning its use, no commercial success has been obtained because of some drawbacks like the excessive hydrophily given to leather and the failure to reach a sufficient shrinkage temperature for some of the subsequent process steps.

By the combined use of these polymers and titanium salts, and applying them under the conditions described in this application leather products have been obtained without the above mentioned defects, showing good flexibility, feel and other characteristics desirable in leather making.

According to the results to be obtained with respect to the intended use or fashion, the leather may be submitted to dyeing, fat liquoring, and treatment with acrylic polymers as fillers and it may be finished with conventional products which are well known according to the previous state of the art.

The boiling treatment of the leather obtained by the present invention does not produce compactation or degradation of the collagen, thus evidencing a good degree of tanning.

PRODUCTS USED IN THE PRESENT INVENTION

First reactant: A derivate of polysaccharids of the type of modified or unmodified cellulose, starch, dextrins or sugars which have been oxidated in a controlled form in order that the carbonyl groups which have been formed may be preferably aldehydic and the carboxylic groups do not represent more than 10% of the carbonyl groups. The aldehydic carbonyl groups are preferably vicinal. The product may be purchased on the market or it may be synthetized by controlled oxidation with hypoclorite in acid medium, with periodic acid or by ozonolisis. A sufficient oxidation degree is around 50% of the OH groups present in the starting material.

Higher oxidation degrees will reduce the affinity of the polymer for titanium. Lower oxidation degrees will hinder the covalent binding of the polymer with the collagen.

Titanium salt: This salt is a compound of ammonium titanyl sulphate which can be found in the market or can be obtained by the precipitation of a solution of titanyl sulphate obtained by the acid treatment of ilmenite and the precipitation by the addition of ammonium sulphate, after the transformation of all the iron to the ferric form as described in Spanish Patent No. 495.110 filed on 17/9/80 as divisional of Patent No. 490.773.

The titanium salt may also be obtained starting from the acid solution after eliminating the ferrous sulphate by crystallization and before heating to precipitate the $Ti(OH)_4$, in the process for the preparation of titanium dioxide by the sulphate method.

This salt does not require any special attention for its preparation, and its titanium contents, expressed as $TiO_2$ is approximately 20%. Although special precautions may have been mentioned to obtain a tanning salt, as in Spanish Patent No. 490.773, with the process provided by the present invention, any type of titanium soluble salt may be used.

Basifying, acidifying and neutralizing compounds: All compounds known in tanning techniques may be used such as for example, carbonates, bicarbonates, sulphites, urotropine, formic acid, sulphuric acid, lactic acid, and the like Fat liquoring: All existing fat liquoring products may be used depending on the item to be prepared, especially unoxidable fats.

Dyeing and finishing: The compounds to be used will depend on the article to be prepared. The solvent free, water based, finishing compounds will be preferable, as well as crosslinking agents based on formol free caseins.

NON LIMITATIVE EXAMPLES

The following examples are provided as being exemplary of the present invention and thus should not be considered in any way to limit the scope of the invention.

EXPLANATION OF THE ABREVIATIONS TO BE USED

D.A.S. 50: Starch with 50% geminal hydroxyl groups oxidated to the aldehyde.

T.A.D.: Ammonium titanyl double sulphate.

Agitation: Rotatory drums.

EXAMPLE 1

Tanning of Cow Hides (% Refers to Weight %)

(1) A cow skin, after deliming and bating operations, is washed with water to eliminate the remaining ammonium salts. If the elimination of the lime has been carried out by means of lactic or boric acid, this washing stage will not be necessary.

(2) The skins, after the deliming and bating operations, with a pH at 7–8, will be treated in a bath with a rate of 300%, previously prepared in the following way: sodic sulphate will be dissolved in the necessary volume of water up to 8% content. The pH is adjusted to 8 with sodium bicarbonate (6–6,5%) and is mixed with 5% D.A.S.-50, and heated up to 60°–70° C., with shaking. Subsequently, the bath is cooled down to room temperature and the skins are treated with the bath, and with drum agitation for 4 hours, leaving the skins to remain in the bath for 14–16 hours. Subsequently the skins are washed with water. In this stage the shrinkage temperature is between 78° and 85° C. At this stage the division of the hide to the desired thickness may be easily carried out due to the consistence given by pretanning with D.A.S.-50.

(3) A pickling treatment is carried out by the addition of 0.5% by in volume of sulphuric acid at a pH up to 2.0 in a bath at 100% and 6°Bé in NaCl.

(4) Subsequently, 25% T.A.D. is added to the bath, with drum agitation for a minimum period of 4 hours. Thereafter, by successive additions of 0.25% sodium bicarbonate diluted to 1% every 60 minutes, the bath will be basified up to pH 2.5. Afterwards, 16 hours of drum agitation will be carried out.

(5) The hides are washed in water to be put in a bath of 200%, 6°Bé in NaCl. 2% of sodic phormiate is added with drum agitation during 60 minutes containing with subsequent additions every 30 minutes of 0.5% sodium bicarbonate until the hide is neutralized to a pH 5.

At this stage, the hide reaches a shrinkage temperature of 93°-97° C., or possibly higher.

(6) Subsequently the hide is submitted to fat liquoring, dyeing, mechanical working and conventional finishing.

EXAMPLE 2

Tanning of Lamb Velours (% Refers to Pickled Weight)

(1) In the same way as in example 1, a previous washing is carried out if the elimination of lime has been made with ammonic salts.

(2) The pickled skins are depickled in a bath at 100%, 6°Bé in NaCl, with a treatment of 2% sodium formiate, with drum agitation during 30 minutes, followed by additions of 1% sodium bicarbonate every 30 minutes, up to pH 8.0.

(3) A 100% bath is prepared by heating water to 60°-70° C., adding sodium sulphate up to 8% with respect to the bath, adjustment the pH to 8.0 with 6-6.5% sodium bicarbonate, and dissolving therein 5% D.A.S.-50 with agitation. The bath is left to cool down to room temperature, and the skins are treated with this bath with drum agitation for 4 hours, leaving the bath to rest for and additional period of 16 hours. In this stage, the shrinkage temperature is about 78°-83° C. Afterwards, the skin are washed with water with agitation in a drum for 10 minutes, are permit to rest for another 15 minutes followed by additional drum agitation.

(4) A new pickling is carried out in a 100%, 6°Bé NaCl bath, with sulphuric acid, in the same way as in paragraph 3 of example 1.

(5) Subsequently, 30% T.A.D., is added to the bath, and submitted to drum agitation for 17 hours. At the end of the period, the pH will be near 1.3, and 99% of the initial T.A.D. will have been absorbed. The shrinkage temperature must be around 86°-90° C.

(6) Subsequently, the bath is basified with additions of 0.25% sodium bicarbonate every 60 minutes up to a pH of 2.5, with drum agitation for 17 hours.

(7) The skins are washed, proceeding to its neutralization to a pH of 5-5.5 as indicated in paragraph 5 of example 1.

(8) Subsequently, conventional fat liquoring, dyeing, mechanical working and finishing stages are carried out.

EXAMPLE 3

Tanning of Lamb Velours. Addition of Solid D.A.S. (% Refers on Pickled Weight)

(1) In the same way as in examples 1 and 2, the washing of the skins are carried out if the elimination of lime has been effected with ammonic salts.

(2) Depickling is carried out with the same process as in paragraph 2 of example 2.

(3) In the same bath resulting from the depickling, 5% D.A.S.-50 is added. Agitation is a drum is carried out up to the solution of the D.A.S.-50 (2 hours approx.), with 3-4 subsequent additional hours of agitation. The bath is left to rest for 16 hours. At this stage, the shrinkage temperature is about 78°-83° C. After ending this process, the skin are washed with water, up to covering, with drum agitation for 20 minutes, stopping for 40 minutes followed by additional drum agitation for 20 minutes.

(4) The bath is changed, proceeding to new pickling with sulphuric acid up to a pH of 2.0 in the same way as explained in paragraph 3 of example 1.

(5) To this bath is added 30% T.A.D., with drum agitation for 17 hours. At this stage, the shrinkage temperature is about 86°-90° C.

(6) Basification continues in the same form as in example 2, up to a pH of 2.5. Drum agitation will be carried out for 16-18 hours. Next, the skins are washed and neutralized to a pH 5-5.5, following the same process as in example 2.

(7) Subsequently, the conventional fat liquoring, dyeing, mechanical working and finishing stages are carried out.

Anything which does not affect, alter, change or modify the essentials of the above process will be deemed as variable to the effects of the present Patent of invention.

We claim:

1. A chromium free process for the tanning of animal hides which includes, after the standard pretreatment of the hide, covalently modifying the skin collagen of said hide by a process which comprises:

contacting said hide with a bath containing a selectively oxidated polysaccharide polymer composition comprising a mixture of the following compounds A, B, C and D represented by the following monomeric formulas:

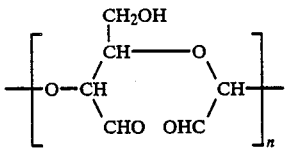

A

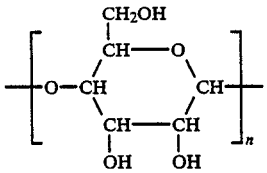

B

-continued

C

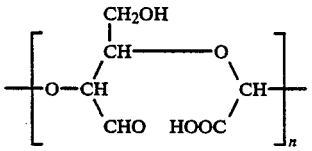

D

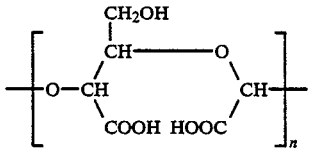

at a pH value of between 7 and 9 for a period of 4 to 24 hours, at room temperature, washing and treating said hide by adding to said bath an acidifying agent at a pH up to 2.0, adding a soluble titanium salt to said bath at a pH of 1.0, basifying said bath up to a pH of 2.5, and neutralizing said hide to a pH of 5.5, and then proceeding with after-treatment to obtain the finished hide product.

2. The process according to claim 1, wherein the quantity of the polymer with respect to the weight of the skin is about 2 to 6% by weight of the humid skin, preferably 4% by weight.

3. The process according to claim 1, wherein the soluble titanium salt is ammonium titanyl double sulphate.

4. The process according to claim 1, wherein the titanium salt has a titanium content of 4 to 6%, preferably 5%, expressed as $TiO_2$ on the moist skin.

5. The process according to claim 1, wherein subsequent dyeing and fat liquoring of the leathers is conducted according to the articles to be obtained.

6. The process according to claim 1, wherein the polymer to be used is cellulose or a cellulose derivative, starch, dextrine or oxidated sugars, which is oxidated by the use of hypochlorite in an acid medium, periodic acid or ozonolysis to the extent of 50% of the OH group present to obtain the desired yield, with the eventual addition of the solid polymer or solution to the polymer in water.

7. The process of claim 1, wherein the animal hides are lamb, goat and calf hides.

* * * * *